US005792030A

United States Patent [19]

Sartore

[11] Patent Number: 5,792,030

[45] Date of Patent: Aug. 11, 1998

[54] BRAKED ROLLER DEVICE FOR CYCLING TRAINING

[75] Inventor: Almerigo Sartore, Fontaniva, Italy

[73] Assignee: Elite S.r.L., Italy

[21] Appl. No.: 736,314

[22] Filed: Oct. 24, 1996

[30] Foreign Application Priority Data

Jun. 3, 1996 [IT] Italy ..... VI96 A 000091

[51] Int. Cl.[6] ..... A63B 22/06; A63B 69/16

[52] U.S. Cl. ..... 482/61; 482/112

[58] Field of Search ..... 482/57, 61, 111, 482/112, 58, 59, 113

[56] References Cited

U.S. PATENT DOCUMENTS

| | | | |
|---|---|---|---|
| 2,507,007 | 4/1950 | Declerco | 482/61 |
| 3,373,992 | 3/1968 | Ludeman | 482/112 |
| 4,645,199 | 2/1987 | Bloemendaal | 482/112 |
| 4,979,735 | 12/1990 | Stewart | 482/111 |
| 5,026,047 | 6/1991 | Kosecoff | 482/61 |
| 5,195,936 | 3/1993 | Mao | 482/112 |
| 5,611,759 | 3/1997 | Zeh et al. | 482/112 |

*Primary Examiner*—Stephen R. Crow

*Attorney, Agent, or Firm*—R. Neil Sudol; Henry D. Coleman

[57] ABSTRACT

A braked roller device for cycling training includes a roller (2) that is rotatably mounted on a support (3) with a substantially horizontal axis (a), and anchored to a stand (4) that is suitable to support the driving wheel (R) of a bicycle so that it is raised from the ground and in contact with the roller (2). A brake (17) is rigidly coupled to the support (3) and acts on the roller (2) to simulate resistance to forward motion. The brake (17) includes a rotor with smooth surfaces, which is rigidly coupled to the roller (2) and is accommodated in a chamber that is closed hermetically and partially filled with a viscous fluid. The rotor is constituted by one or more disks with substantially flat and parallel side faces made of relatively rigid material, each part being optionally provided with two or more lateral holes for the controlled flow of the fluid.

8 Claims, 4 Drawing Sheets

BRAKED ROLLER DEVICE FOR CYCLING TRAINING

BACKGROUND OF THE INVENTION

1. Field of the Invention

The present invention relates to a braked roller device for cycling training, of the type which includes a rotating roller which has a substantially horizontal axis and is mounted on a support, a means for detachably anchoring the support to a stand for supporting the rear wheel of a bicycle so that it is raised from the ground and in contact with the roller, and a braking means which is rigidly coupled to the support and acts on the roller to simulate the effort of forward motion.

2. Description of the Prior Art.

Devices of the type described above can be used by professional or amateur athletes and even by ordinary people for sports, hobby, or therapeutic purposes, in enclosed spaces or in any case in static conditions, at any time of the day and regardless of the weather conditions, so as to avoid any limitation or risk linked to road traffic.

It is known that a vehicle's resistance to forward motion, regardless of the elevation changes in the path, varies in proportion to the square of the relative speed.

Accordingly, in order to simulate real operation correctly, braked roller devices must provide a variable resistance that increases at least in proportion to the increase in speed, that is to say, in the rotation rate of the roller.

For this purpose, it is possible to plot the braking force (torque) as a function of the speed (rpm rate), coupling the roller to a variable-speed electric motor on whose power supply circuit an ammeter is parallel-connected to measure the absorbed current.

Roller devices are known in which the braking means is constituted by a flywheel and by a fan that are keyed to the ends of a roller that is arranged in contact with the driving wheel of the bicycle. This device offers considerable static torque, does not allow to correctly simulate resistance to the stroke of the pedal as speed increases, and is excessively noisy.

In order to obviate these drawbacks, magnetic-type braked rollers have been devised; in these rollers, the braking means is constituted by a disk made of nonmagnetic material that is keyed on the roller and is immersed in a magnetic field which is generated, for example, by permanent magnets associated with the support. The characteristic curve of the device is approximately linear up to a speed of approximately 30 km/h and therefore in this range the device is able to simulate the forward motion effort of the cyclist with a certain effectiveness.

However, probably due to the high magnetic leakage, no significant increase in resistance is observed for rotation rates above the one that corresponds to 30 km/h. In practice, the characteristic curve of these braked rollers is of the linear type up to a rotation rate that corresponds to a linear speed of approximately 30 km/h, after which it becomes substantially flat or constant as the rotation rate varies.

Devices with a fluid roller are also known; in these devices, the braking means is constituted by a bladed impeller that is immersed in a viscous fluid, for example a particular oil, contained in a hermetically closed chamber, as described in U.S. Pat. No. 5,195,936.

A drawback of these known fluid-based devices is the fact that the vane assembly of the impeller has a geometry that is designed to operate correctly in a certain direction of rotation, so that a rotation in the opposite direction would produce a drastically lower resistance.

Accordingly, the roller, which is normally supplied in disassembled condition, must be fixed to the stand in a very specific position, which depends on the assigned direction of rotation.

In other conventional fluid-based devices, described for example in U.S. Pat. No. 4,645,199 and U.S. Pat. No. 5,542,507, the impeller does not have vanes but has peripheral cutouts or depressions on the lateral surfaces, causing vibration and noise.

SUMMARY OF THE INVENTION

The aim of the present invention is to overcome the above described drawbacks by providing a fluid-braked roller device whose operating characteristic curve is approximately linear in the entire operating range.

A particular object is to provide a braked roller device that is independent of the direction of rotation and can therefore be installed on the stand of the bicycle in any position.

This aim, this object, and others that will become apparent hereinafter are achieved by a braked roller device of the type defined in the premises, characterized in that the braking means includes a rotor with substantially smooth surfaces, which is keyed on the roller and is accommodated in a main chamber that is closed hermetically and filled with a viscous fluid.

The fluid contained in the main chamber applies a fluidodynamic resistance to the surface of the rotor; the resistance is substantially uniform and increases according to a substantially linear relation as the speed increases. By virtue of the geometry of the rotor, the direction of rotation does not affect the behavior of the rotor and therefore the resistance-generating roller can be installed in any position on the supporting stand.

Preferably, the rotor is constituted by at least one disk member with substantially flat and parallel lateral faces made of relatively rigid material.

As an alternative, the rotor can be composed of a plurality of disk members rigidly mounted on the roller in side-by-side and axially offset positions.

Each disk member has one or more lateral holes for the controlled flow of the fluid from one face to the other of the disk member.

The main chamber can be formed by two facing half-shells that are detachably and peripherally coupled and have, on their outer surface, a plurality of cooling fins which are substantially parallel and vertical or slightly inclined with respect to the vertical.

BRIEF DESCRIPTION OF THE DRAWINGS

Further characteristics and advantages will become apparent from the following detailed description of a non-limitative example of embodiment of a resistance-generating roller according to the invention, illustrated with the aid of the accompanying drawings, wherein.

DESCRIPTION OF THE PREFERRED EMBODIMENTS OF THE INVENTION

Figure 1:
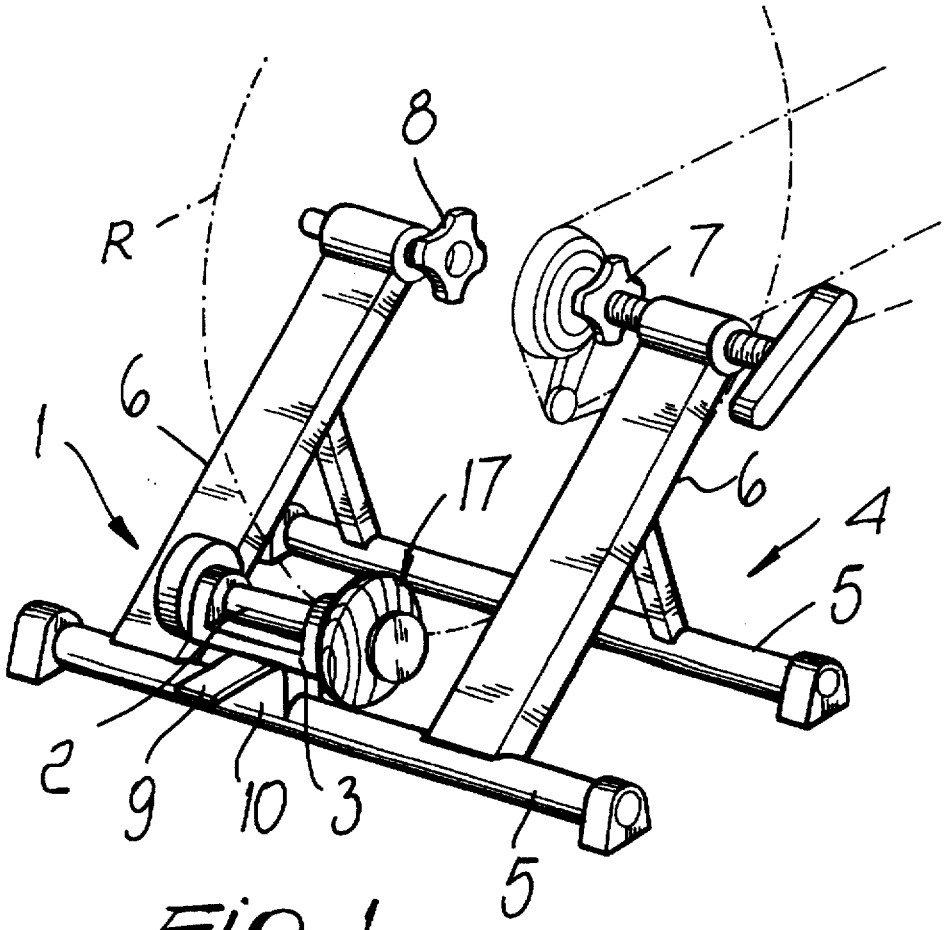
FIG. 1 is a general perspective view of the roller variator according to the invention, to which a bicycle wheel is coupled.
Figure 2:
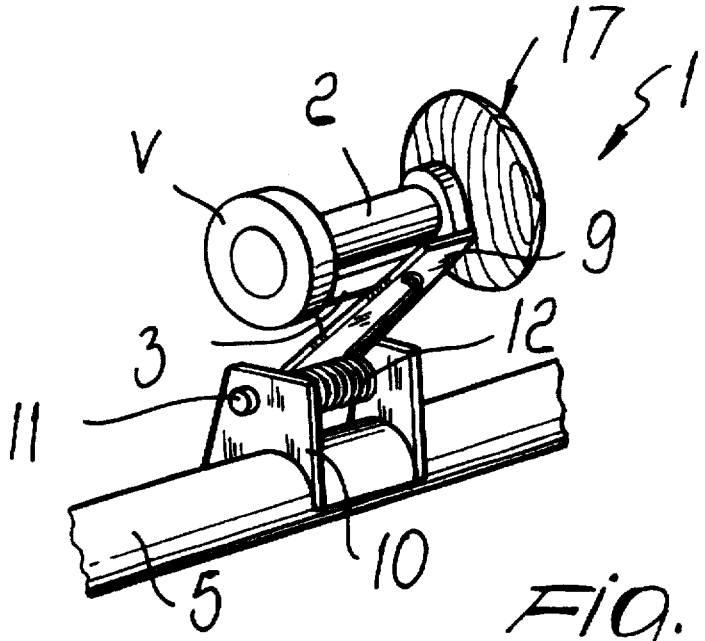
FIG. 2 is a detail perspective view of the roller variator of FIG. 1.
Figure 3:
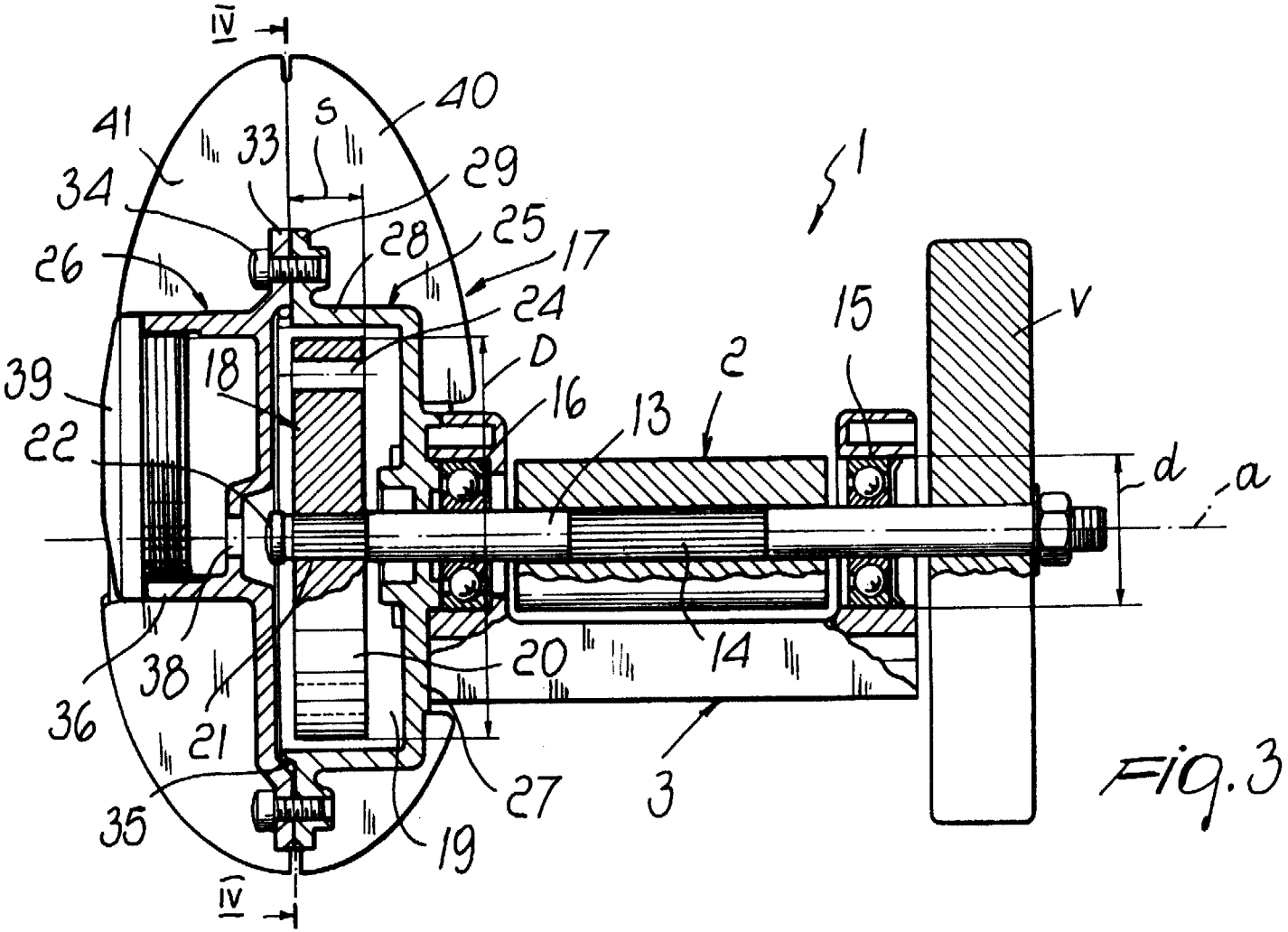
FIG. 3 is a partially sectional view of the roller variator according to the invention, taken along an axial plane.

With reference to the above figures, a braked roller device according to the invention, generally designated by the reference numeral 1, essentially includes a roller 2 that has a substantially horizontal axis a and is mounted on a support 3 that can be anchored to a stand 4, made of metal tubes, which supports the rear wheel R of a bicycle so as to keep it raised from the ground and in contact with roller 2.

The stand, which is of a conventional type, can be made of two cross-members 5 with rubber end supports, on which inclined posts 6 are welded which respectively upwardly support a screw clamp 7 and a fixed support 8 for locking the rear wheel R of a bicycle in a position in which it is raised from the ground and is in contact with roller 2.

Support 3 can be anchored to the stand by means of a connecting plate 9 pivoted, by means of a pivot 11, on a fork-like bracket 10 that is rigidly coupled to a cross-member 5. A spiral spring 12, mounted on pivot 11, acts elastically on plate 9, keeping the roller constantly raised and forced against the wheel R.

Roller 2 is constituted by a cylindrical part, made for example of steel or reinforced polymeric material, with an outside diameter d, which is fixed to a rigid axle 13 by means of longitudinal grooves 14. The axle is in turn mounted on two end roller bearings 15 and 16 that are anchored to support 3.

A roller braking means, generally designated by the reference numeral 17, is provided at one end of support 3 to simulate resistance to forward motion.

In particular, the braking means 17 includes a rotor 18 that is keyed to one end of axle 13 and is accommodated in a hermetically sealed chamber 19, which is filled with a fluid, for example a medium-viscosity hydraulic oil, and has inside dimensions that are slightly larger than the rotor.

The amount of fluid that fills chamber 19 can vary from a minimum of 50% to a maximum of 95% depending on the intensity of the desired braking effect.

Rotor 18 can be constituted by a single disk member 20 made of metallic or plastic material, having a diameter D of, for example, 50 to 100 mm and a thickness S of, for example, 10 to 20 mm, with parallel and flat faces and a circular peripheral surface, and with a central hole. The disk member is fixed to axle 13 by means of grooves 21 and a locking screw 22. By virtue of the considerable dimensions of the disk member 20, the roller has a considerable inertia that provides uniform rotation.

Figure 4:
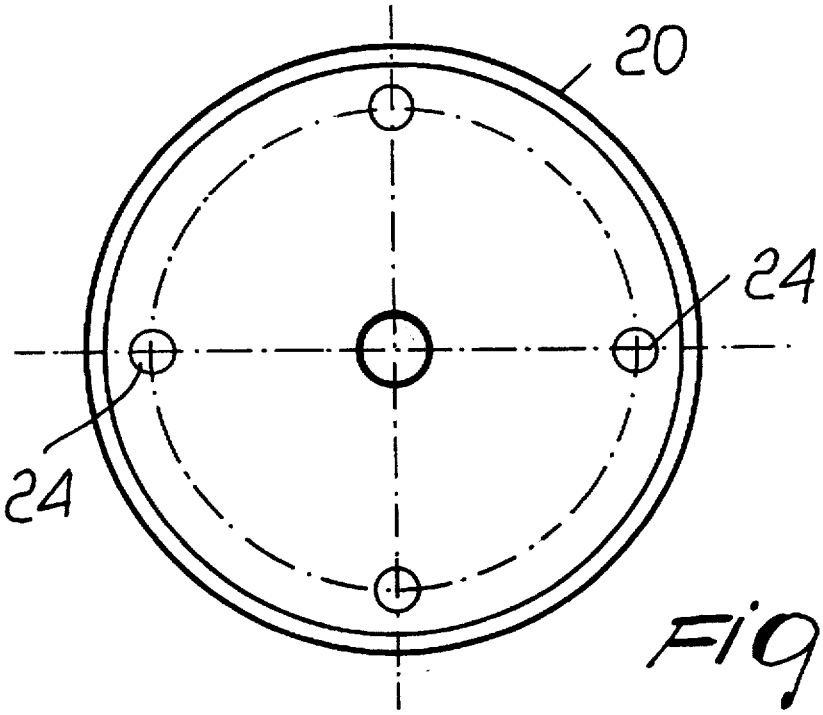
FIG. 4 is a sectional view of a detail of the device of FIG. 3, taken along the transverse plane IV—IV.
Figure 5:
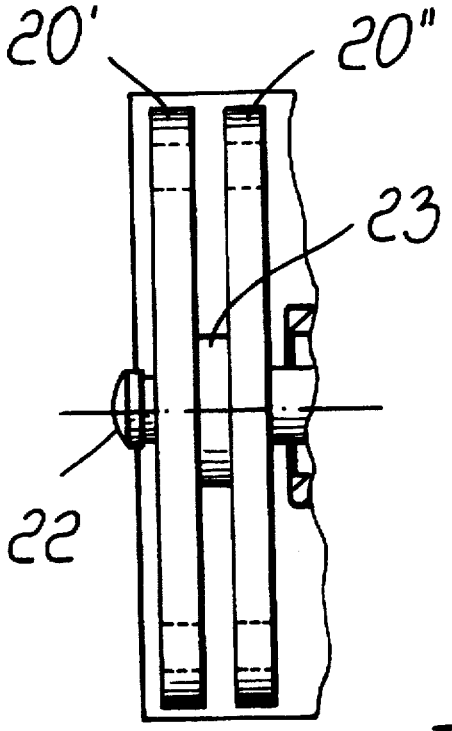
FIG. 5 is a partially sectional view of a detail of FIG. 3 in an alternative embodiment.

As an alternative, rotor 18 can be constituted by two or more side-by-side disk members 20', 20" that also have substantially flat lateral surfaces having a diameter D and a thickness S/2, separated by a spacer washer 23, as shown in FIG. 4. The surface of the rotor that is wet by the viscous fluid in this last case is substantially twice that of the first one, with a corresponding increase in the braking effect.

Conveniently, it is possible to provide on each disk member 20, 20', 20" two or more holes 24, preferably through holes, that run parallel to the axis a of roller 2. The holes are arranged along a circumference that is concentric to the axis a, in diametrically opposite and angularly equidistant positions.

During the rotation of rotor 18, the fluid is centrifugally propelled outward and tends to circulate in chamber 19, passing through holes 24 By virtue of the geometry of the rotor, which is perfectly symmetrical with respect to the axis a, it is possible to use both directions of rotation without any change to the braking effect.

Optionally, it is possible to install a small flywheel mass V at the end of axle 13, that lies opposite to rotor 18, in order to even out the motion.

The main chamber 19 is preferably formed by two facing half-shells 25 and 26.

The first half-shell 25 has a side wall 27 that is substantially flat and a peripheral wall 28 that has an approximately cylindrical shape, with a slightly larger diameter than rotor 18 and with a connecting flange 29. A central hole 30 for the passage of axle 13 and surfaces 31 for coupling to support 3 are provided on the side wall 27.

The second half-shell 26 has a side wall 32 that is substantially flat and has a peripheral flange 33 that can be coupled to flange 29 of first half-shell 25 by means of screws 34 and a sealing O-ring 35.

A substantially cylindrical wall 36 protrudes outward from the side wall 32 of the half-shell 26 and forms, together with the side wall 32, a reservoir or expansion chamber 37 for collecting and compensating the oscillations of the fluid during operation. The tank 37 is connected to chamber 19 by means of a central hole 38 and is provided with a screw-on plug 39 for replenishing the tank with the fluid.

Both half-shells 25 and 26 have respective rows of substantially flat and parallel cooling fins 40 and 41 on their outer surfaces. Preferably, fins 40 and 41 are arranged in an approximately vertical or slightly inclined direction, so as to facilitate heat dissipation and cooling of the viscous fluid. Furthermore, the outer edges of the cooling fins 40 and 41 are shaped so as to form a particular oval structure of the assembly.

Figure 6:
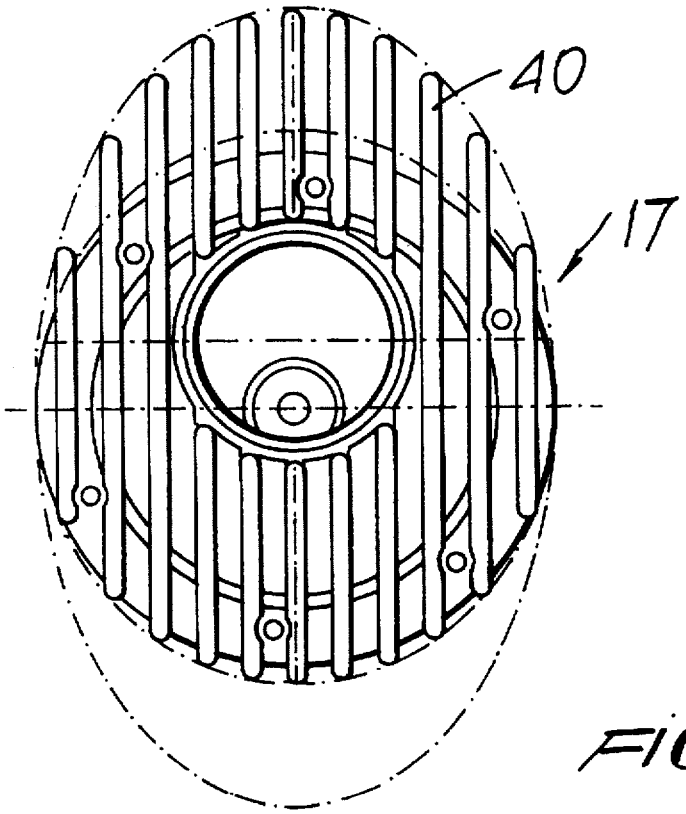
FIG. 6 is a side view of a detail of the roller device according to the invention.
Figure 7:
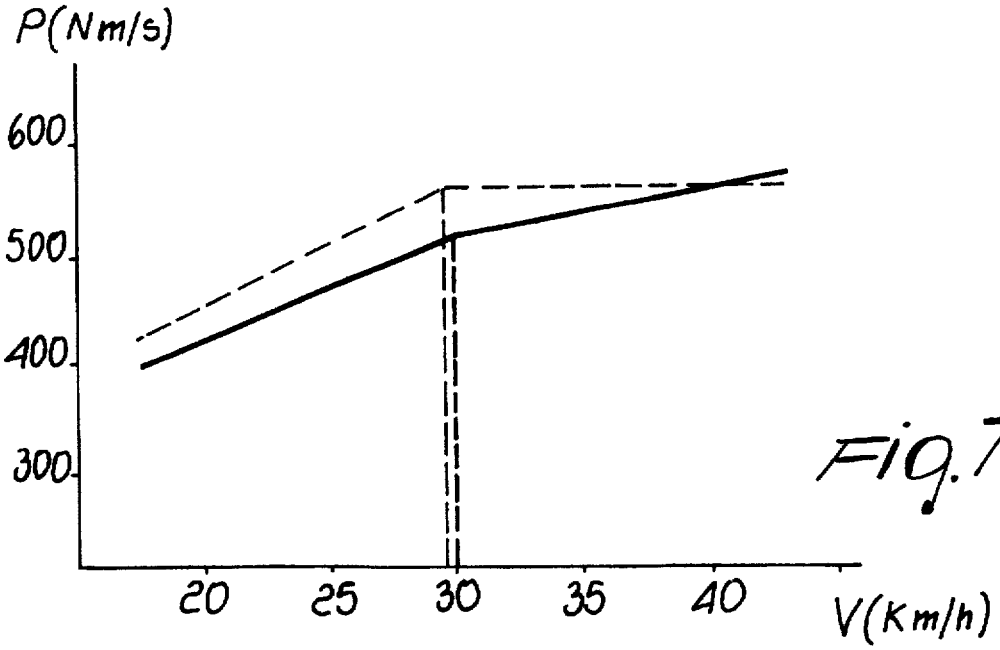
FIG. 7 plots the characteristic curve of the operation of the device according to the invention, compared with a device of the prior art.

FIG. 6 depicts the operating curve in solid lines measured for the device according to the invention, compared to the operating curve of a device of the prior art, shown in broken lines.

It is noted that in the device according to the invention, for roller rotation rates higher than a linear speed of approximately 30 km/h, the slope of the curve remains substantially constant, whereas in the device of the prior art it decreases drastically and tends to become zero.

I claim:

1. A braked roller device for cycling training, comprising:

a stand;

a support on said stand;

a roller rotatably mounted on said support for rotation about a substantially horizontal axis, said stand including at least one member for supporting the driving wheel of a bicycle so that the driving wheel is raised from the ground and in contact with said roller;

a means for anchoring said support to said stand; and a braking means rigidly coupled to said support and acting on said roller to simulate resistance to forward motion, said braking means including a chamber and a rotor disposed in said chamber, said rotor being rigidly coupled to said roller, said chamber being hermetically closed and at least partially filled with a viscous fluid, said rotor including at least one disk member having substantially continuous and smooth faces and provided with at least one throughhole for the controlled flow of the viscous fluid from one of said faces to another of said faces.

2. The device according to claim 1 wherein said rotor comprises at least two disk members that are rigidly mounted to said roller in side-by-side and axially offset positions.

3. The device according to claim 1 wherein at least two throughholes are provided in said disk member, said throughholes extending substantially parallel to said axis, said throughholes being angularly equidistant from one another and disposed at a common radial distance from said axis.

4. The device according to claim 1 wherein said face are substantially flat and parallel to one another, said faces being made of a relatively rigid material.

5. The device according to claim 1, further comprising a flywheel mass and an axle, said axle having a first end and a second end, said roller being mounted at said first end of said axle, said flywheel mass being coupled to said second end of said axle.

6. The device according to claim 1 wherein said chamber is formed by two facing half-shells that are detachably and peripherally coupled, said half-shells having outer surfaces provided with a plurality of cooling fins.

7. The device according to claim 6 wherein said cooling fins are substantially parallel and substantially vertical.

8. The device according to claim 7 wherein said cooling fins are slightly inclined with respect to the vertical.

* * * * *